United States Patent [19]

Corbiere

[11] 4,005,569

[45] Feb. 1, 1977

[54] TEXTURED YARN

[76] Inventor: Claude Corbiere, Villa "Ce Regal, " Route de Saint-Alban, Riorges, Loire (42), France

[22] Filed: Oct. 2, 1974

[21] Appl. No.: 511,373

Related U.S. Application Data

[62] Division of Ser. No. 241,166, April 5, 1972, abandoned.

[52] U.S. Cl. ..... 57/140 J; 28/72.16; 57/157 MS; 428/369

[51] Int. Cl.[2] ..... D02G 3/24; D02G 1/00

[58] Field of Search ..... 57/140 J, 140 R, 34 HS, 57/157 MS, 157 R; 28/72.16; 428/362, 369–371

[56] References Cited

UNITED STATES PATENTS

| | | | |
|---|---|---|---|
| 3,305,911 | 2/1967 | Chapman et al. | 28/72.16 X |
| 3,332,226 | 7/1967 | Rosenstein | 57/140 J |
| 3,568,278 | 3/1971 | Mattingly | 28/72.16 |

*Primary Examiner*—John Petrakes
*Attorney, Agent, or Firm*—Sherman & Shalloway

[57] ABSTRACT

A textured yarn composed of continuous filaments having a crimp with marked cusps, the molecular structure of the continuous filaments in the cusps being different from the molecular structure of the portions of the continuous filaments between consecutive cusps. A process for manufacturing the above-described textured yarn including knitting a yarn composed of drawable continuous thermoplastic filaments to form a knitted fabric, drawing the knitted fabric with a force close to but at the maximum equal to the maximum drawing force that the drawable yarn could withstand without breaking the filaments and deknitting the drawn knitted fabric.

16 Claims, 8 Drawing Figures

TEXTURED YARN

This is a division of application Ser. No. 241,166, filed Apr. 5, 1972, now abandoned.

BACKGROUND OF THE INVENTION

1. Field of the Invention

The present invention pertains to textured yarn and, more particularly, to such yarn having a crimp with marked cusps and a process of manufacturing the same.

2. Discussion of the Prior Art

It is a necessity in the textile industry to include a drawing step with structural modification of the filaments when processing continuous filament thermoplastic yarns. Indeed, if the yarn is not drawn or is insufficiently drawn, it is essentially useless for the production of fabric since drawable yarn is brittle and lacks elasticity. The necessity of drawing seems to be by-passed in few cases, when fully drawn yarn is obtained directly below the spinnerette. But, even in such cases, the drawing step is performed "on-line" to obtain appropriate orientation of the polymer macromolecules. The drawing is thus performed by very expensive apparatus installed below the spinnerette which operates at very high speeds in the range of 3,000 m/min or more on each single strand of flat yarn. The resulting product is only flat yarn, for which the subsequent processing step may be texturizing, which is necessarily performed by other machines. Normal texturizing is a very slow process operating in the range of 200 m/min on each single strand or yarn. After texturizing, the product has a much greater commercial value.

The most widely used approach to drawing now practiced in industry is the use of drawtwisters; i.e., the use of machines located after and apart from the spinning apparatus. On drawtwisters, each strand of yarn is separately drawn over a drawing rod, and many rods are installed side-by-side on a general frame. Generally, each yarn being drawn advances through an upstream set of rollers at a speed related to the draw ratio, and exits from a downstream set of rollers at a higher speed of approximately 1,000 m/min. Each yarn is then taken up on bobbins or, more generally, on pirns which have a peripheral speed matching the exit speed of the yarn. The resulting product is flat yarn, for which the subsequent processing step may be texturizing, as above.

In some cases, the above-cited drawing is directly combined on-line with false-twist texturizing. The false-twist equipment is then placed on a common frame directly after the above-cited downstream set of rollers. The exit speed of the yarn is then limited by the texturizing part to approximately 200 m/min, and the resulting product is texturized yarn.

Another approach to drawing yarn is disclosed in U.S. Pat. No. 3,568,278, issued to Mattingly. In Mattingly, a filament of undrawn yarn is stitched into a chain of loops in which three sections of the yarn extend between each pair of loop bites. The yarn is then drawn while arranged as a chain of loops to produce drawn yarn having crimps formed at the bite of each loop. The chain of loops is then deknitted, and the resulting strand of yarn is bulked by passing the yarn over a sharp edge or through an air blast stream after deknitting. The resulting product is then a flat yarn with scattered crimps (or cusps) and cannot be used nor presented as a texturized yarn without further treatment being applied to each strand of yarn. Further texturizing treatment is not disclosed in the Mattingly process.

The process disclosed by Mattingly is of limited economic feasibility and has not been generally adopted due to the poor bulk quality of the product and due to a poor production rate per strand of yarn. Indeed, since the process is necessarily realized on-line from undrawn to bulked yarn for each single strand of yarn, the exit speed (i.e., the matching take-up speed of the yarn) limits the production rate to a level equivalent to the level of the above-cited drawtwisters. The fact that three sections of yarn are in parallel array during the drawing has no influence on the production rate.

In addition, the subsequent crimping step or overcrimping step occurring after deknitting would be performed on a single strand of yarn moving at a speed of 1,000 m/min, and it is doubtful that the technology for accomplishing this crimping at such a speed exists. Furthermore, it is well known that it is difficult to economically crimp a single strand of yarn. It is thereby concluded that stitching yarn into a single row of stitches, as taught by Mattingly, does not offer an economical alternative to the widely used afore-described methods in which strands of yarn are drawn in parallel and texturized in parallel or are draw-texturized in parallel.

The prior art also includes U.S. Pat. No. 3,305,911 issued to Chapman et al. which discloses the concept of knitting undrawn yarn into a tubular fabric and then drawing the fabric to produce a fabric of drawn yarn having crimps therein. Chapman et al. is, however, not concerned with a knit-deknit process for producing individual strands of yarn. Consequently, Chapman et al. is not confronted with the problem of deknitting drawn yarn from a fabric, the yarn of which fabric has been crimped by drawing the fabric.

Bulking of yarn is an additional consideration and it is well known to modify the bulk and/or the extensibility of continuous filament thermoplastic yarns through various mechanical processes by deforming the yarns, the deformation being simultaneously or subsequently set through an appropriate heat treatment. Attempts have been made, for example, to deform a bundle of filaments either by means of a false twist spindle or by passage over a sharp edge in order to produce a three-dimensional helicoidal crimp, or by passage into a gear mechanism or by packing into a so-called "stuffer box" in order to produce a flat three-dimensional crimp.

Another well known mechanical process consists of knitting drawn yarn inthe form of a flat knit or a tube, heat setting the knitted fabric and finally deknitting or unraveling the yarn. This method, which is returning to popularity, is often called KDK (Knit-Deknit), or knitting-setting-deknitting. The textured yarns obtained with this process, sometimes called "crinkle" yarns are characterized by a substantially flat crimp having a deep sinusoidal configuration. These yarns, which are used particularly in hosiery and for manufacturing footwear and sweaters, often lack elasticity; and, moreover, due to the configuration of the crimp, the articles woven or knitted from these yarns present a defective appearance primarily caused by synchronism of yarn deformation. To improve crimp regularity and the elasticity of such yarns, it has been proposed to heatset the knit while maintaining it under regulated tension. The yarns thus obtained show marked loops, separated by essentially parallel yarn portions, and have increased internal crimp characteristics.

With the packing or compression mechanical texturing process mentioned above, it has been proposed to modify the voluminocity of thermoplastic yarns by compressing the yarns in a special box, referred to as a stuffing or packing box, and simultaneously or subsequently setting the deformation thus produced in the yarn. yarns produced by such process have a characteristic crimp, called a straight serrated crimp, i.e., in the shape of a more-or-less open V. The latter process, however, which is well known, still has certain disadvantages since it cannot be easily applied to a single strand of yarn of average count, and is even more difficult to apply to yarn of low count. As a result, the yarn obtained not only lacks bulk and elasticity, but the production cost is very high. This is particularly so for the yarns for textile end uses.

SUMMARY OF THE INVENTION

Accordingly, it is an object of the present invention to provide a process for manufacturing a textured yarn overcoming the above-mentioned disadvantages and to provide an improved textured yarn.

The present invention is generally characterized in a textured yarn composed of continuous filaments having a crimp with marked cusps, the molecular structure of the continuous filaments in the cusps being different from the molecular structure of the portions of the continuous filaments between consecutive cusps. The present invention is further characterized in a process for manufacturing the above-described textured yarn including the steps of knitting a yarn composed of drawable, continuous thermoplastic filaments to form a knitted fabric, drawing the knitted fabric without breaking the filaments and deknitting the drawn knitted fabric.

A further object of the present invention is to provide an improved knitting-deknitting process for manufacturing a continuous filament textured yarn.

The present invention has another object in that the drawing or tensile force applied to the knitted fabric after knitting and prior to deknitting is close to, but at the maximum equal to, the drawing or tensile force susceptible of being applied to the drawable yarn prior to knitting without breaking the yarn; that is, the maximum drawing force applied to the knitted fabric is determined by the tensile strength of the drawable yarn.

Yet a further object of the present invention is to at least partially set a yarn textured with a knitting-deknitting process by the release of energy as a result of drawing the yarn.

An additional object of the present invention is to improve the setting of a shape imparted to a yarn by drawing a knitted fabric and, therefore, to substantially improve the crimp power by subjecting the knitted fabric to an additional heat treatment. The additional heat treatment may be performed either simultaneously with the drawing or stretching of the knitted fabric in any suitable manner, preferably by utilizing steam, it being noted that with certain materials the simultaneous heat treatment facilitates the drawing of the yarn, or after the drawing or stretching and prior to deknitting, preferably making certain to maintain the drawn knitted fabric under appropriate tension.

The present invention has another object in the manufacture of a textured yarn composed of continuous primary filaments, preferably a multi-filament yarn, the yarn having at least one serrated-type crimp with marked cusps, the molecular structure of the primary filaments being different and less organized in the cusps than in the portions of the primary filaments interconnecting consecutive cusps.

Another object of the present invention is to subject a yarn after the texturing treatment to another mechanical deformation, which deformation is eventually heat set. As an example, the drawn knit may be passed between the cogged wheels of a gear drive with the three-dimensional crimp yarn obtained therefrom having improved voluminocity and/or extensibility and/or elasticity.

Some of the advantages of the present invention over the prior art are that elasticity and extensibility of the textured yarn are increased and that the process of the present invention and, consequently, the apparatus required therefor is simple thereby facilitating thereof.

Other objects and advantages of the present invention will become apparent from the following description of the preferred embodiments taken in conjunction with the accompanying drawings.

BRIEF DESCRIPTION OF THE DRAWINGS

FIG. 8 is an elevation of a filament of yarn after the yarn had been drawn, while knitted in sock form, and then subsequently mechanically deformed by a stuffing box, gear crimper of the like.

DESCRIPTION OF THE PREFERRED EMBODIMENTS

Figure 3:
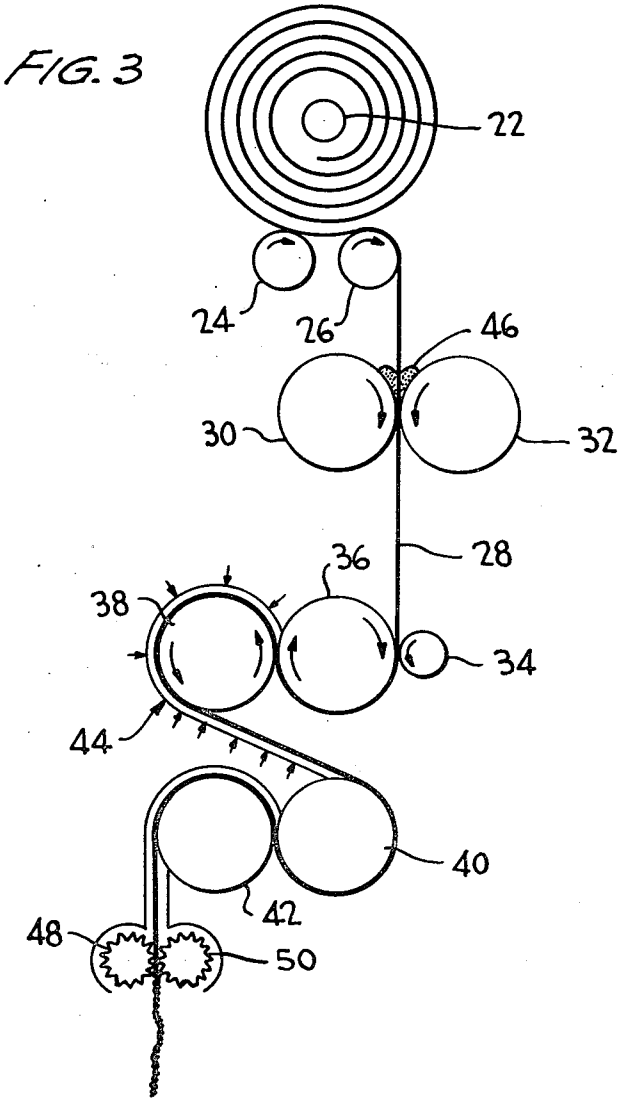
FIG. 3 is a diagrammatical illustration of a further embodiment of apparatus for manufacturing textured yarn according to the present invention.

The present invention pertains to thermoplastic yarns composed of continuous filaments at the most only partially drawn; that is, undrawn yarns or only partially drawn or partially oriented yarns (i.e., the invention pertains to drawable yarns). The drawing of continuous filament yarns is well known per se, and results in a longitudinal arrangement or orientation of the molecules of which the yarn is composed; and, accordingly, the yarn is provided with mechanical properties such as elongation and breakage or tensile strength. The initial drawing operation which, dependent upon the nature of the yarn and the desired results is either a cold drawing or a dry or wet-heat drawing, is performed on special machines referred to as drawing frames which are heavy, bulky, costly and noisy.

The terms "drawable yarn" as used herein define yarn susceptible to substantial plastic elongation, generally irreversibly, that is, yarm which can be drawn according to the nature of the yarn but at least 50%. In other words, the terms "undrawn yarns", "drawable yarns" "not completely drawn yarns", as well as "partially drawn yarns" are equivalent and are defined by an indication of the amount of drawing which can still be imparted to the yarn with reference to the elongation of the yarn at the breakage point prior to drawing. If the elongation at breakage or a normal drawn yarn is between 5 and 50 percent, the elongation at breakage of a partially drawn yarn is higher. There are many thermoplastic polymers susceptible to such plastic drawing after extrusion, for example, polyamides, e.g. poly E-caprolactam, polyhexamethyleneadipamide, polyhexamethylene sebacamide and poly 11-undecanoic acid; linear polyesters, e.g. polyethylene terephthalate, polyethylene adipate, polyethylene azelate, polyethylene meleate, polyethylene isophthalate, etc; polyolefins, e.g. polypropylene, polyacrylonitriles and the like.

In accordance with the present invention a drawable yarn is knitted in any manner known in the art preferably being provided with a tubular configuration. For practical and economical reasons, the yarn is advantageously knitted with a simple stocking stitch; however, it will be appreciated that other stitches, such as the chain stitch, 1/1 rib and stitches derived therefrom, may be utilized with the present invention. In order to facilitate the feeding of the undrawn yarn and the deknitting of the drawn knitted fabric, a machine of the monofeedtype may be advantageously utilized.

Drawing of the knitted fabric may be performed in any suitable well known manner taking care not to break the filaments composing the undrawn yarn. It has been found that better results are obtained when prior to the drawing of the knitted fabric, the fabric is progressively placed under tension in that, with such progressive tension, the stitches, and therefore the yarns, are properly positioned with respect to each other devoid of overlapping. While for practical and economical reasons the knitted fabric is generally drawn longitudinally, that is, to increase the length dimension of the knitted fabric, the knitted fabric may also, if desired, be drawn transversely to increase the width dimension of the knitted fabric. The geometry or configuration of the deformation of the resulting textured yarn is dependent upon the direction of drawing of the knitted fabric.

The drawing operation may be performed utilizing any known drawing means. For example, if a longitudinal drawing is desired, a set of rollers rotating at appropriate speeds may be utilized; and if a transverse drawing is desired, a tenter may be utilized. The knitted fabric may also be drawn in accordance with the present invention in both longitudinal and transverse directions, for example around a frog which is a rigid body, substantially ellipsoidal, that is introduced inside the tubular structure so that, when traction is exerted on this tubular structure, it will be elongated in two dimensions as it advances. The drawing operation, whether transverse, longitudinal or both, may be modified to vary the amount of drawing.

Figure 1:
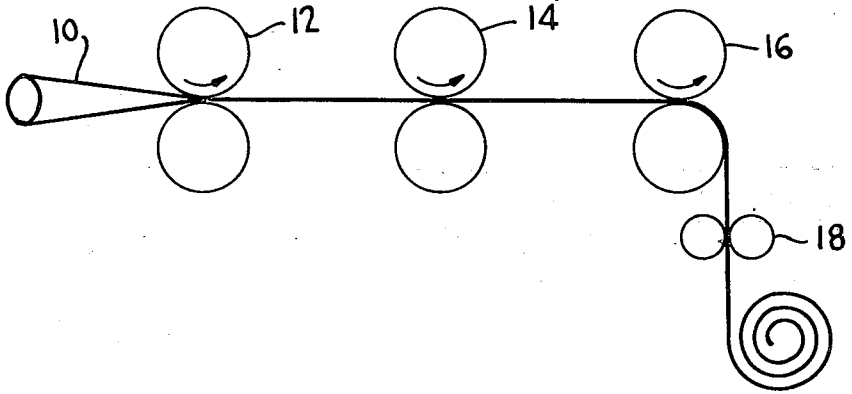
FIG. 1 is a diagrammatical illustration of apparatus for manufacturing textured yarn in accordance with the present invention.

In FIG. 1 apparatus is diagrammatically illustrated for longitudinally drawing or stretching a tubular knitted fabric 10, the apparatus including a retaining mechanism 12 which receives the tubular fabric from a knitting machine (not shown), a delivery mechanism 14 receiving the tubular knitted fabric from the retaining mechanism and supplying the knitted fabric to a drawing mechanism 16 with the retaining, delivery and drawing mechanism each being formed by two cylindrical rollers or a set of cylindrical rollers. From the drawing mechanism 16 the drawn, knitted fabric is supplied by means of rollers 18 to either a collection station or, in the case of continuous operation, to suitable deknitting apparatus.

The tubular knitted fabric experiences appropriate pretension as it is moved between the retaining mechanism 12 and the delivery mechanism 14; and, as the tubular knitted fabric moves between delivery mechanism 14 and drawing mechanism 16, it is stretched by controlled regulation of the respective speeds of the rollers of the delivery and drawing mechanisms. The speeds required for proper drawing may be determined easily by one of ordinary skill in the art with such speeds being a function of the amount of stretching to be applied to the drawable yarn forming the knitted fabric. As will be appreciated, the drawing apparatus may take any desired form as long as the desired stretching can be applied to the yarns of the knitted fabric. For instance, yarns of the knitted fabric may be suitably stretched with the knitted fabric merely passing between the rollers of the drawing mechanism.

Figure 4:
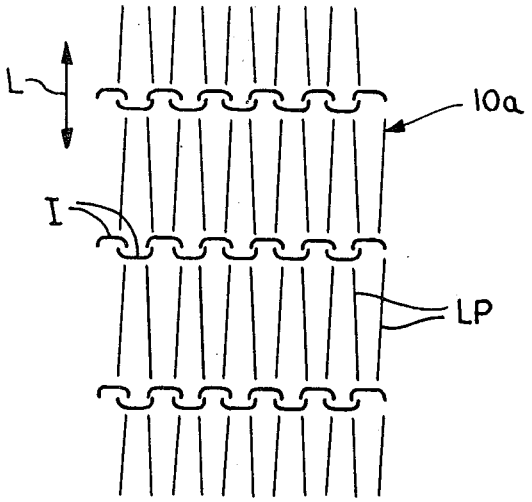
FIG. 4 is a partial plan view of a longitudinally drawn knitted fabric.
Figure 6:
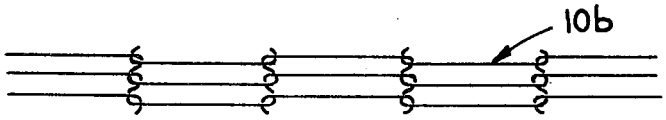
FIG. 6 is a partial plan view of a transversely drawn knitted fabric.

A knitted fabric **10*a* longitudinally drawn by the apparatus of FIG. 1 is illustrated in FIG. 4 with the longitudinal dimension of the fabric denoted by an arrow L. As can be seen from FIG. 4, longitudinally extending portions LP of the yarn have been substantially stretched whereas the interlaced or interlocking portions I are not so affected due to the reinforcement thereof by each other. In FIG. 6 a knitted fabric 10*b* that has been transversely drawn in a manner similar to that of the knitted fabric 10*a*** is illustrated, and it will be noted that laterally or transversely extending portions TP are substantially stretched whereas interlocking portions IP are not so affected similarly due to their reinforcement of each other.

Once the knitted fabric is drawn or during the drawing step, the knitted fabric may be subjected to an additional heat treatment, preferably under tension, in order to improve the setting of the deformation of the yarn caused by the drawing. That is, the deformation or stretching of the yarn in the knitted fabric is at least partially set by the heat from the energy released during the drawing operation; however, in order to improve the setting of the deformation, the yarn may be subjected to additional heat. Any appropriate heat treating means may be utilized to provide such additional heat treatment. If the additional heat treatment is performed simultaneously with the drawing step, it has been found that good results are obtained utilizing steam with a polyester yarn knit, such steam heating also facilitating the drawing step. If the additional heat treatment is performed after the drawing step, the heat treatment may be performed either continuously, for example by passage adjacent a heat strip or through a heated enclosure, or discontinuously, for example by placing the drawn knitted fabric in an oven. As has been previously mentioned, the additional heat treatment step is advantageously effected while maintaining the knitted fabric under tension.

The deknitting operation may be performed by any process and apparatus well known in the art and may be effected in a continuous or discontinuous manner either at the place where the knitted fabric is drawn or at a remote place where the textured yarn produced by the process of the present invention is to be utilized. In addition to the essential steps of knitting a drawable yarn to form a knitted fabric, drawing the knitted fabric and deknitting the drawn knitted fabric, the process of the present invention may be associated or coordinated with other process steps or operations thereby permitting a wide variation in the range and properties of products produced. For example, the drawable knitted yarn may be initially dyed with either plain dye or multi-colored dye or may be in points thereby permitting the dyeing operation to economically be integrated with the texturing process. The integration of the dyeing step as mentioned above is particularly effective in the production of dyed textured polyamide yarns.

In a similar fashion, after drawing the knitted fabric but prior to deknitting thereof, the voluminosity, extensibility and/or electricity of the yarn may be adjusted by subjecting the drawn knitted fabric to overstretching and/or relaxation in a manner known in the art. This treatment, currently utilized with synthetic yarns, may be carried out immediately after drawing via the combined effects of heat and tension. For example, overstretching of polyester yarn knits is extremely advantageous. An amount of overstretch greater than 1 is applied to a knitted fabric of polyester yarns while with polyamide yarn knitted fabrics, a relaxation is applied with the amount less than 1.

The textured yarn of the present invention has a substantially flat crimp; and, in order to improve the voluminosity and/or irregular appearance of the textured yarn, the drawn knitted fabric may be deformed prior to deknitting, the deformation being eventually set. Excellent results are obtained by passing the drawn knitted fabric between heated cogged wheels or rollers such as of a gear mechanism with the textured yarn thus obtained having superimposed crimps in different planes. Thus, the textured yarn has increased voluminosity and presents a more blurred or jumbled appearance.

Figure 2:
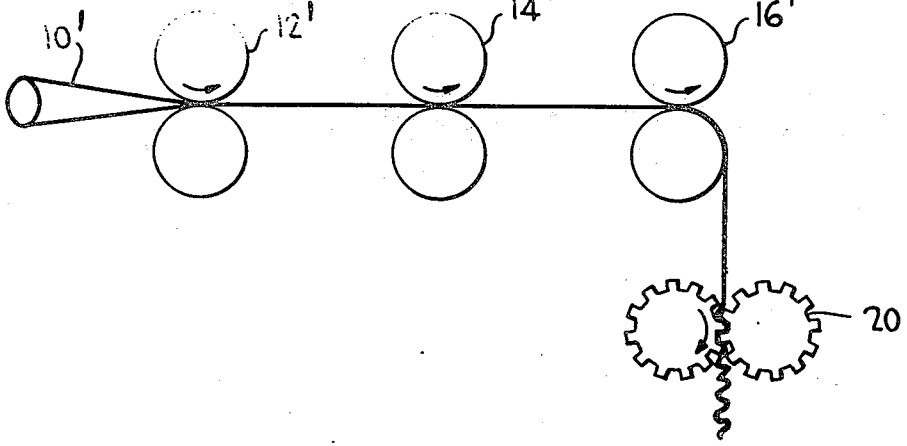
FIG. 2 is a diagrammatical illustration of a modification of the apparatus of FIG. 1 to manufacture textured yarn according to the present invention.

Apparatus for providing the above described deformation step along with the process of the present invention is illustrated diagrammatically in FIG. 2 with components of FIG. 2 identical to components of FIG. 1 being given identical reference numbers with a prime added and not described again. The partially drawn knitted fabric 10' after being placed under tension between sets of rollers 12' and 14' is drawn sets of rollers 14' and 16'; and, then, while maintaining controlled tension on the drawn knitted fabric, it passes between the heated cogged wheels of a gear mechanism 20. The cogs of gear mechanism 20 are arranged, for example, transversely to the plane formed by the drawn knitted fabric to deform the fabric in a direction aplanar to the fabric. The cogs of the gear mechanism 20 deform mechanically successive portions of the tubular knitted fabric 10' to form periodic variations therein.

A particularly advantageous embodiment of the present invention will now be described with respect to apparatus diagrammatically illustrated in FIG. 3.

A drawable yarn is knitted into a tubular fabric in a conventional manner and the fabric is wound or rolled on a beam 22 to engage a pair of idle rollers 24 and 26 which have a smooth steel outer surface and are slightly braked. The knitted fabric 28 formed of the drawable yarn passes from idle roller 26 between a pair of rollers 30 and 32 which are biased against each other in order to provide a braking function. Rollers 30 and 32 have external surfaces coated with a flexible material to prevent sliding of the knitted fabric 28 as the fabric passes therebetween. For example, a device well known in dyeing, referred to as a padding mangle or foulard which is composed of a pair of rubber-coated steel rollers, may be utilized.

From rollers 30 and 32 the fabric 28 passes through a set of rollers including a pressing roller 34 and delivery rollers 36 and 38. The fabric 28 passes between the pressing roller 34 and delivery roller 36 around the lower periphery of delivery roller 36, between delivery rollers 36 and 38 and around a substantial portion of delivery roller 38 greater than 180°. The set of rollers 34, 36, and 38 define a delivery and self-tightening or tensioning device which places the fabric under tension between rollers 30 and 32 and 34 and 36 and provides a positive feed with respect to following drawing rollers 40 and 42.

Rollers 36 and 38 and rollers 40 and 42 are driven positively at peripheral speeds selected such that the difference therebetween is regulated in order to produce a desired stretching of the fabric and, therefore, the knitted yarn. In order to provide precision control of the tension in the yarns of the fabric, the rollers 36, 38, 40 and 42 have external surfaces formed to prevent slipping or skidding of the fabric therearound by any suitable means, such as coating the surfaces with rubber. To facilitate the drawing step, a heating treatment is applied to the fabric at 44 for example by a steam rail, such heat being distributed all along the travel path of the fabric between rollers 38 and 40 and, for certain applications, rollers 36, 38, 40 and 42, may also be heated. According to a variation of the present invention particularly suitable for treating poly amide yarns, the knitted fabric, prior to drawing, is dyed in a continuous manner, for instance by placing a dye material 46 at the nip between rollers 30 and 32 such that the rollers 30 and 32 serve as a dyeing pad.

According to a further variation of the process of the present invention, the drawn knitted fabric after existing roller 42 passes between a pair of heated wheels or rollers 48 and 50 of a deforming gear mechanism. The heated cog wheels or rollers 48 and 50 deform the knitted fabric 28 to form periodic variations therein. Once the fabric has existed the apparatus of FIG. 3, it is deknitted either continuously or discontinuously by means of conventional apparatus and processes not shown.

Figure 5:
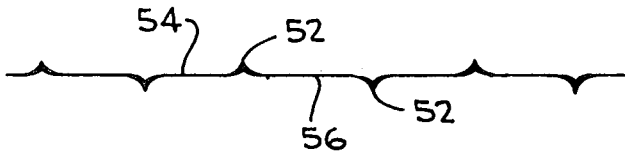
FIG. 5 is an elevation of a filament of a yarn of the knitted fabric of FIG. 4.

The process of the present invention may be effectively and successfully utilized with all continuous filament thermoplastic yarns of both monofilament and multifilament types. Preferably, the yarns treated have a total count and number of filaments common in texturing operations; and, depending on the final application intended for the textured yarns, the yarns treated are polyamide, polyester, polyolefin, polyacrylic yarns and the like. As previously stated, textured yarns according to the present invention have at least one crimp of the serrated type having marked cusps, and such yarns are characterized in that the molecular structure of the primary filaments is different and less organized in the cusps 52 as illustrated in FIG. 5 than in the portions 54 and 56 of the filaments interconnecting consecutive cusps. The difference in molecular structure is easily determined through any appropriate physical means, such as X-ray apparatus. In practice, the molecular structural differences may be seen as a difference in the affinity of the yarns to dye at the cusps 52 as compared to the portions 54 and 56, and such differential dyeing affinity permits the obtention of advantageous esthetic effects.

The filament illustrated in FIG. 5 is from the longitudinally drawn knitted fabric 10*a* of FIG. 4 and, as stated above, is composed of alternating substantially straight portions 54 and 56 inter-connecting marked cusps 52. Each cusp 52 is composed of two small curved portions, substantially similar, forming an acute apex angle.

Figure 7:
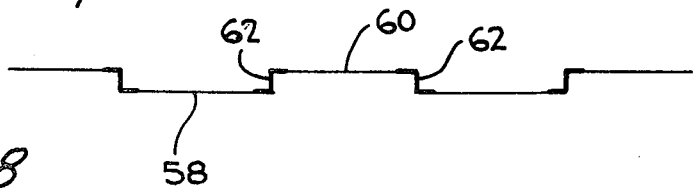
FIG. 7 is an elevation of a filament of a yarn of the knitted fabric of FIG. 6.

The filament illustrated in FIG. 7 is from the transversely drawn knitted fabric 10*b* of FIG. 6 and has a castellated or crenellated configuration in which substantially straight portions 58 and 60 interconnect cusps 62 made up of substantially straight segments in an S or Z fashion such that the middle section is substantially transverse or at a right angle to portions 58 and 60.

The process of the present invention has many advantages over prior art processes since the yarn is drawn in the form of a knitted fabric thereby simplifying and facilitating the construction of equipment to advantageously replace conventional drawing frames previously utilized in the field and thereby substantially reducing the problems of space, cost, weight and noise inherent in conventional drawing frames. Furthermore, to obtain the same amount or quality of drawing, that is, to operate at a similar total speed with a similar yield, the knitted fabric may be drawn at a low speed in accordance with the present invention, as compared with the high speed required for a drawing frame in which each yarn is individually drawn. Thus, the present invention provides simple and economical solutions to existing problems in the art, and the process of the present invention is compatible with the construction of drawing machines while permitting an increase in the output of such machines. Furthermore, due to the slow working speeds which may be utilized with the present invention without decreasing production, the process of the present invention facilitates the integration within the process of supplementary operations such as dyeing, overstretching and relaxation, which supplementary operations cannot be easily integrated with conventional drawing systems.

The steps of the process of the present invention may be separated; for example, the deknitting step may be performed at the place where the yarn is transformed into fabric thereby facilitating the problems of transporting, storage and delivery of the yarn and/or the deknitting step can be integrated with conventional yarn delivery operations such as winding and coning, for example, on the premises of the user.

The process and product of the present invention will now be described in connection with the following examples, which examples are presented for purposes of illustration only, and the present invention is in no way to be deemed as limited thereto.

EXAMPLE 1

A 158 dtex, 13 filaments, polyamide 6.6 yarn, susceptible of being imparted a 3.6 amount of drawing, is knitted on a tubular knitted machine for jersey fabric of the monofeed type, formed of 300 needles.

By means of apparatus, such as that shown diagrammatically in FIG. 1, the knitted fabric is drawn longitudinally in such a manner that the yarn is drawn 3.6 times its original length, then the drawn knit is wound or rolled up under tension and finally the drawn knit is heat treated in an autoclave for 15 minutes at 110° C.

After deknitting, the yarn obtained has approximately 44 dtex with a flat crimp of the type illustrated in FIG. 5, with the cusps having a molecular structure different from that of the substantially straight portions interconnecting the cusps.

The molecular structural differences, made obvious by a subsequent dyeing, are translated by a speckled or flecked effect in a knitted or woven article made from the yarn.

EXAMPLE 2

Example 1 is repeated, with the exception that the heat treatment is effected not in an autoclave, but continuously during the drawing operation, by passage in front of a heating strip 60 cm long, heated at 170° C. During this heat treatment, the knitted fabric is maintained under tension by means of two sets of rollers at opposite ends of the heating strip rotating at the same speed.

As in the preceding example, the yarn obtained has a flat crimp, which is serrated and in which the cusps have a molecular structure different from that of the straight portions.

EXAMPLE 3

Example 2 is repeated, while allowing the knit to shrink longitudinally under controlled tension. In this case, the set of rollers downstream of the heating strip rotates at a speed slightly lower than that of the set of rollers upstream of the heating strip, the difference being regulated as a function of the desired amount of shrinkage in the yarn.

The yarn obtained is a shrunk, set, textured yarn, having a flat crimp of the type illustrated in FIG. 5.

EXAMPLE 4

The yarn of ethylene glycol polyterephthalate, 250 dtex, 33 filaments, susceptible of being imparted an amount of drawing of 3.5, is knitted on a 300- needle, monofeed, tubular knitting machine.

By means of the apparatus illustrated in FIG. 3 and in which a heating rail is fed with steam at 90° C, the knitted yarn is drawn in such a manner that the yarn is drawn 3.5 times its original length.

The yarn obtained has a flat crimp of the type shown in FIG. 5.

The resulting textured polyester yarn is particularly suitable for hosiery, in particular for the manufacture of overclothing (sweaters and pullovers). Through a subsequent dyeing (of the yarn or in the piece), the difference in molecular structure is revealed between the cusps and the straight portions therebetween which gives an original and desirable speckled appearance to the articles made from the textured yarn.

EXAMPLE 5

Example 4 is repeated, with the following modifications:

the polyester yarn is replaced by a polyamide 6.6 yarn, similar to that of example 1 (158 dtex, 13 filaments, amount of drawing 3.6);

the knitted fabric is drawn 3.6 times its original length; and a dyeing bath is placed in the space between rolles 30 and 32.

This process integrates dyeing, drawing and texturing, and is particularly economical.

EXAMPLE 6

Example 1 is repeated, but using apparatus similar to that of FIG. 2.

After drawing, the knit fabric passes perpendicularly between two cogged rollers heated at 220° C and forming a gear mechanism, the speed of the cogged rollers and the drawing rollers being substantially the same so that the knitted fabric is held under only slight tension.

After deknitting, the yarn obtained has a three-dimensional crimp resulting from the superimposing of two types of curls, one due to the treatment by means of the gear mechanism, the other due to the process of the present invention. These two types of crimp are substantially perpendicular to each other.

EXAMPLE 7

A double feed tubular knitting machine for jersey fabric is fed as follow:

one feed with a polyamide 6.6 yarn, 158 dtex, 13 filaments, susceptible of being imparted a drawing of 3.6; and one feed with an ethylene glycol polyterephthalate yarn, 250 dtex, 33 filaments, susceptible of being imparted a drawing of 3.5.

By means of apparatus such as shown in FIG. 3, this knitted fabric is drawn in such a manner that the yarns are drawn 3.5 times their original length.

The two yarns are deknitted together, and because of their position in the knitted fabric, they have the form of a composite yarn with a low twist.

The drawing or stretching step of the present invention may be performed within a wide temperature range. That is, the drawable yarns in the knitted fabric may be either cold drawn or drawn under the influence of heat. The energy released concomitant with the stretching of the yarns during the drawing step permits at least a partial setting of the deformation caused by the stretching and in some cases may provide sufficient heat to provide a fully acceptable setting of the deformation without the addition of a further heat treatment. However, in order to assure proper setting of the deformation of the yarns during the drawing step, heat may be applied either simultaneously with the drawing step or thereafter. The drawing ratio of the knitted fabric is determined by the characteristics of the drawable yarns such that the drawable yarns are stretched during the drawing step with a force close to but at the maximum equal to the maximum drawing force or tensile strength of the drawable yarn. That is, as will be appreciated, knitted frabrics inherently have a stretching potential due to the nature thereof; and, accordingly, the stretching of the knitted fabric is determined in accordance with the drawing force to which the drawable yarn could withstand.

From the examples it can be seen that the drawing or stretching ratio is normally in the vicinity of 3.5 and preferably is within a range of from 1.1 to 7.0 dependent upon the nature of the drawable yarns of the knitted fabric. Similarly, the drawing step may be accomplished at ambient temperature with additional heat treatment for setting if required or, as noted in Example 4, steam at 90° C. may be utilized to facilitate the drawing operation. While the temperature at which the drawing step is performed may vary dependent upon the nature of the drawable yarns and the ultimate textured yarn to be produced, a preferable range of temperature is up to 150° C.

The term "cusps", as utilized in describing the textured yarn of the present invention, is defined as a point where the yarn abruptly changes direction in order to form an apex. That is, the "cusps" of the textured yarn according to the present invention define a thickened portion of a continuous filament wherein the filament changes direction. For instance, in the textured yarn of FIG. 5 produced by longitudinal drawing of the knitted fabric of FIG. 4, the cusps 52 are each composed of a pair of arcuate sections meeting at an apex to undergo an abrupt change of direction; and in the textured yarn of FIG. 7 produced by transverse drawing of the knitted fabric of FIG. 6, the cusps 62 form a pair of apexes each of which defines a 90° change in direction of the continuous filament with the cusps being thickened relative to the interconnecting portions 58 and 60. As was mentioned above, the cusps are formed by the interlocking nature of the yarns of the knitted fabric and, thus, it will be appreciated that the textured yarns of FIGS. 5 and 7 are illustrative only and that the cusps or thickened portions of the filaments undergo a change of direction which may have any desired configuration in accordance with the stitch configuration of the undrawn knitted fabric.

Figure 8:
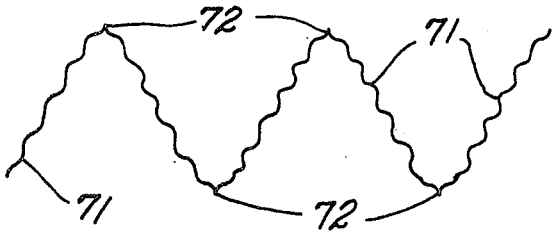

As seen in FIG. 8, when the yarn filaments of FIG. 5 or FIG. 7 are deformed by further crimping, as with the cog wheel 5 of FIG. 2, or for example, with a conventional stuffer box, "micro-crimps" 71 are formed between thickened portions or cusps 72, which resulted from previous drawing of the yarn, while in knitted sock form. Generally, the "micro-crimps" 71 periodically occur with relatively random spacing, while the cusps 72 occur with uniform spacing. The uniform spacing is due to the yarn being drawn, while knitted into a sock. Furthermore, the "micro-crimps" are generally formed normal to the plane of the sock, while the macro-crimps are formed generally in the plane of the sock.

Inasmuch as the present invention is subject to many variations, modifications and changes in detail, it is intended that all matter described above or shown in the accompanying drawings be interpreted as illustrative and not in a limiting sense. cm What is claimed is:

1. A textured yarn composed of continuous filaments and having a crimp with equally spaced marked cusps, the molecular structure of said continuous filaments in said cusps being different from the molecular structure of the portions of said continuous filaments between consecutive cusps, and additional deformations on said filaments, wherein said additional deformations occur between said cusps.

2. A textured yarn as recited in claim 1 wherein said yarn is composed of a bundle of continuous multi-filaments.

3. A textured yarn as recited in claim 1 wherein said crimp is flat.

4. A textured yarn composed of continuous filaments having a crimp with a plurality of equally spaced thickened areas in which said continuous filaments change direction and a plurality of portions interconnecting said thickened areas, the molecular structure of said continuous filaments in said thickened areas being different from the molecular structure of said continuous filaments in said plurality of interconnecting portions and said interconnecting portions having a cross-sectional dimension less than the cross-sectional dimension of said thickened areas, said crimp further including additional deformations on said filaments, wherein said additional deformations occur between said thickened areas.

5. The textured yarn as recited in claim 4 wherein said thickened areas include oppositely curved sections joined at an apex.

6. The textured yarn as recited in claim 4 wherein said thickened areas have a Z configuration.

7. A textured yarn composed of continuous filaments, wherein the yarn has spaced cusps of a relatively thick cross-sectional area, forming periodically occurring macro-crimps, in which the molecular structure of the macro-crimps is different from the molecular structure of the yarn, between the macro-crimps; said yarn also having micro-crimps occurring with a period less than the period of said macro-crimps, so that there are micro-crimps disposed between said macro-crimps that have a cross-sectional area less those of said macro-crimps.

8. The textured yarn of claim 7, wherein the macro-crimps occur with a regular period.

9. The textured yarn of claim 8, wherein the micro-crimps occur with a random period.

10. The textured yarn of claim 9, wherein the micro-crimps are generally oriented normal to the macro-crimps.

11. The textured yarn of claim 7, wherein the micro-crimps occurs with a random period.

12. The textured yarn of claim 7, wherein the micro-crimps are generally oriented normal to the macro-crimps.

13. A textured yarn composed of continuous filaments, wherein the yarn has spaced thickened cusps forming macro-crimps, which occur with a regular period, and in which the molecular structure of the macro-crimps is different from the molecular structure of the yarn between the macro-crimps; said yarn also having micro-crimps randomly occurring with a period less than the period of said macro-crimps, so that there are micro-crimps disposed between said macro-crimps.

14. The textured yarn of claim 4, wherein said additional deformations occur with random spacing therebetween.

15. The textured yarn of claim 1, wherein said additional deformations occur with random spacing therebetween.

16. The textured yarn of claim 4, wherein the additional deformations are generally oriented normal to the extent of the thickened areas.

* * * * *